US010062948B2

(12) United States Patent
Madle

(10) Patent No.: US 10,062,948 B2
(45) Date of Patent: Aug. 28, 2018

(54) MICROWAVE CAVITY RESONATOR

(71) Applicant: Andrew Wireless Systems GmbH, Buchdorf (DE)

(72) Inventor: Erik Madle, Hradec Kralove (CZ)

(73) Assignee: Andrew Wireless Systems GmbH, Buchdorf (DE)

( * ) Notice: Subject to any disclaimer, the term of this patent is extended or adjusted under 35 U.S.C. 154(b) by 0 days.

(21) Appl. No.: 15/301,007

(22) PCT Filed: Apr. 1, 2015

(86) PCT No.: PCT/EP2015/057226
§ 371 (c)(1),
(2) Date: Sep. 30, 2016

(87) PCT Pub. No.: WO2015/150477
PCT Pub. Date: Oct. 8, 2015

(65) Prior Publication Data

US 2017/0025735 A1 Jan. 26, 2017

(30) Foreign Application Priority Data

Apr. 2, 2014 (EP) ..... 14163187

(51) Int. Cl.
*H01P 7/04* (2006.01)
*H01P 7/06* (2006.01)
*H01P 1/208* (2006.01)

(52) U.S. Cl.
CPC ..... *H01P 7/04* (2013.01); *H01P 1/208* (2013.01); *H01P 7/06* (2013.01)

(58) Field of Classification Search
CPC ..... H01P 7/04; H01P 7/06; H01P 1/208
(Continued)

(56) References Cited

U.S. PATENT DOCUMENTS 2,171,219 A 8/1939 Malter
2,500,875 A 3/1950 Schupbach
(Continued)

FOREIGN PATENT DOCUMENTS

CN 101312263 11/2008

OTHER PUBLICATIONS

International Search Authority, "International Search Report and Written Opinion from PCT/EP2015/057226", dated Jun. 24, 2015, pp. 1-10, Published in: WO.

*Primary Examiner* — Rakesh Patel
(74) *Attorney, Agent, or Firm* — Fogg & Powers LLC

(57) ABSTRACT

One embodiment is directed to a microwave cavity resonator comprises a cavity housing forming a cavity. A resonator element is arranged in the cavity and extends longitudinally along a longitudinal axis, wherein the resonator element comprises, when viewed along the longitudinal axis, a first end connected to a first housing wall and a second end opposite the first end, the second end being arranged at a distance from a second housing wall. The resonator element, at its second end, comprises at least one first capacitor element and the cavity housing comprises at least one second capacitor element reaching into the cavity and arranged at a distance, when viewed along a direction perpendicular to the longitudinal axis, from the at least one first capacitor element such that a gap between the at least one first capacitor element and the at least one second capacitor element is formed.

16 Claims, 5 Drawing Sheets

(58) Field of Classification Search
USPC ..... 333/208, 209, 222, 223, 227, 231, 232, 333/233
See application file for complete search history.

(56) References Cited

U.S. PATENT DOCUMENTS

| | | | | |
|---|---|---|---|---|
| 3,448,412 | A | 6/1969 | Johnson | |
| 6,396,366 | B1 * | 5/2002 | Raty | H01P 7/04 333/222 |
| 2015/0288044 | A1 * | 10/2015 | Schoninger | H01P 1/2053 333/207 |

* cited by examiner

MICROWAVE CAVITY RESONATOR

CROSS-REFERENCE TO RELATED APPLICATIONS

This application is a U.S. National Stage application of PCT Application Serial No. PCT/EP2015/057226, filed Apr. 1, 2015, which claims the benefit of EP Patent Application Serial No. 14163187.9, filed Apr. 2, 2014, the contents of all of which are hereby incorporated by reference.

BACKGROUND

This disclosure relates to a microwave cavity resonator.

A microwave cavity resonator of this kind comprises a cavity housing forming a cavity, the cavity housing comprising a first housing wall and a second housing wall opposite the first housing wall. A resonator element is arranged in the cavity and extends longitudinally along a longitudinal axis. The resonator element comprises, when viewed along the longitudinal axis, a first end connected to the first housing wall and a second end opposite the first end, the second end being arranged at a distance from the second housing wall.

A microwave cavity resonator of this kind may for example be used in a microwave filter, for example a band pass filter or a band stop filter, in a multiplexer or in another radiofrequency (RF) device.

A microwave filter including multiple cavity resonators is for example known from U.S. Pat. No. 6,735,766. A resonator element placed within a cavity of a cavity resonator is herein attached with its first end to a bottom wall of a cavity housing and with a second end is arranged at a distance from a housing cover opposite the bottom wall. The second end of the resonator element hence represents an open end which is not connected to the housing cover.

Within a cavity resonator of this kind the resonator element comprises an electrical length of a quarter wavelength at the resonant frequency of the cavity resonator. This poses a limit for the dimensions of such cavity resonators, which may be in contrast to a desire for a miniaturization and for low production costs.

It has been proposed to place a capacitor element at the second, open end of the resonator element in order to increase the capacitance in-between the second, open end of the resonator element and the surrounding cavity housing. This allows to shorten the resonator element.

In EP 1 118 134 B1 a cavity resonator is described in which discs are placed in the vicinity of the second, open end of the resonator element, the discs electrically interacting with plates on the cavity housing in order to increase the capacitance in-between the second, open end of the resonator element and the cavity housing.

There is a desire to increase the capacitance between the second, open end of the resonator element and the surrounding cavity housing further. Herein, in known solutions, it is necessary to arrange the second end of the resonator element with respect to the surrounding housing such that a relatively small gap in-between the second end of the resonator element and one or multiple housing walls of the housing is obtained. Such arrangements are sensitive to tolerances and sometimes are mechanically and electrically unstable over the operational range of temperatures.

From U.S. Pat. No. 3,448,412 a miniaturized tunable resonator is known in which a movable assembly, together with a cylindrical member, forms a structure similar to a folded coaxial line and hence a resonator within a cavity.

SUMMARY

In one example, a microwave cavity resonator is provided that allows for decreasing the dimensions of the cavity resonator while at the same time exhibiting a mechanically and electrically stable behavior and having a high quality (Q) factor.

This can be achieved, for example, with a microwave cavity resonator comprising a cavity housing forming a cavity, the cavity housing comprising a first housing wall and a second housing wall opposite the first housing wall. The microwave cavity also comprises a resonator element arranged in the cavity and extending longitudinally along a longitudinal axis, wherein the resonator element comprises, when viewed along the longitudinal axis, a first end connected to the first housing wall and a second end opposite the first end, the second end being arranged at a distance from the second housing wall. The resonator element, at its second end, comprises at least one first capacitor element and the cavity housing comprises at least one second capacitor element reaching into the cavity and arranged at a distance, when viewed along a direction perpendicular to the longitudinal axis, from the at least one first capacitor element such that a gap between the at least one first capacitor element and the at least one second capacitor element is formed.

One example starts from the idea to provide one or multiple first capacitor elements at the second, open end of the resonator element. Such first capacitor elements on the second end of the resonator element are associated with one or multiple second capacitor elements on the housing of the cavity resonator such that a capacitance in-between the one or the multiple first capacitor elements and the one or multiple second capacitor elements is formed.

By increasing the capacitance in-between the second, open end of the resonator element and the cavity housing, it becomes possible to shorten the length of the resonator element below the required electrical length of a quarter wavelength in a quarter-wavelength resonator. The physical length of the resonator element can hence be decreased below a quarter wavelength while maintaining the electrical length of the resonator element at a quarter wavelength.

The at least one first capacitor element (arranged on the second, open end of the resonator element) and the at least one second capacitor element (arranged on the housing) are placed with respect to one another such that a gap is formed in-between the capacitor elements. Herein, the at least one first capacitor element and the at least one second capacitor element are displaced with respect to each other in a direction perpendicular to the longitudinal axis along which the resonator element extends. In particular, the at least one first capacitor element and the at least one second capacitor element may be arranged coaxially to each other such that a second capacitor element arranged on the housing surrounds a first capacitor element arranged on the second, open end of the resonator element circumferentially about the longitudinal axis.

The at least one first capacitor element and the at least one second capacitor element for example may have a cylindrical shape, wherein the at least one first capacitor element and the at least one second capacitor element are arranged coaxially with respect to each other. Multiple first capacitor elements herein may intermesh with multiple second capacitor elements such that an intermeshed arrangement of capacitor elements is obtained.

The shape of the at least one first capacitor element and the at least one second capacitor element, however, is not limited to a cylindrical shape. Just as well, the at least one first capacitor element and the at least one second capacitor element can have a quadratic or rectangular shape (when viewed in cross section in a crosssectional plane perpendicular to the longitudinal axis).

In particular, when having multiple first capacitor elements intermesh with multiple second capacitor elements, one second capacitor element is arranged spatially in-between two first capacitor elements and one first capacitor element is arranged spatially in-between two second capacitor elements. When viewed in a direction perpendicular to the longitudinal axis, hence, a first capacitor element connected to the second, open end of the resonator element is followed by a second capacitor element connected to the housing, which again is followed by a first capacitor element connected to the second, open end of the resonator element, and so on. In-between the different capacitor elements a gap is formed such that a capacitance between the capacitor elements is provided.

The at least one second capacitor element, in one embodiment, may be arranged on the second housing wall. The at least one second capacitor element hence is connected to the second housing wall of the cavity housing opposite the first housing wall to which the resonator element is connected with its first end. The at least one second capacitor element extends from the second housing wall and reaches into the cavity along the longitudinal axis such that a gap is formed between the at least one second capacitor element on the second housing wall and the at least one first capacitor element on the second, open end of the resonator element.

In another embodiment, the at least one second capacitor element may be arranged on a side wall of the cavity housing extending in-between the first housing wall and the second housing wall. From the side wall the at least one second capacitor element reaches into the cavity, wherein the at least one second capacitor element may for example be connected to the side wall via a base such that the at least one second capacitor element is arranged coaxially to the resonator element at a distance from the side wall of the cavity housing.

Multiple first capacitor elements, in one embodiment, are connected to the second, open end of the resonator element via a first base extending in a plane perpendicular to the longitudinal axis. The first base is attached to the resonator element in the vicinity of the second, open end of the resonator element and carries the multiple first capacitor elements, wherein the multiple first capacitor elements are arranged coaxially with respect to each other.

In another embodiment, multiple first capacitor elements may be connected to each other via a first base extending along a plane perpendicular to the longitudinal axis, wherein the connection to the resonator element is provided via for example the innermost first capacitor element, but not the base.

From the first base, the multiple first capacitor elements may extend towards the second housing wall and/or towards the first housing wall. If the multiple first capacitor elements are arranged coaxially with respect to each other, they may for example be connected to each other via the first base at a side of the multiple first capacitor elements facing away from the second housing wall in which case the multiple first capacitor elements extend from the base towards the second housing wall. Or the base may be arranged at a side of the first capacitor elements facing the second housing wall in which case the multiple first capacitor elements extend from the base towards the first housing wall.

A portion of at least one first capacitor element can extend from the first base towards the second housing wall, whereas a second portion of the at least one first capacitor element extends from the first base towards the first housing wall. A first portion of the at least one first capacitor element hence is arranged on the base to protrude towards the second housing wall, whereas a second portion points towards the first housing wall and hence in an opposite direction.

In one embodiment, multiple second capacitor elements are connected to each other via a second base extending along a plane perpendicular to the longitudinal axis. Multiple second capacitor elements connected to the housing hence are carried by a common, second base. Via the second base the second capacitor elements may for example be connected to a side wall or the second housing wall of the housing.

In one embodiment, a tuning device is arranged at the second housing wall, the tuning device having a shaft extending into the cavity along the longitudinal axis. The shaft is arranged coaxially to the resonator element and is adjustable in its position along the longitudinal axis in order to tune the microwave cavity resonator. The tuning device may for example be embodied as a tuning screw which with its shaft can be screwed into or screwed out of the cavity such that the length of the shaft reaching into the cavity may be adjusted. The shaft of the tuning device may, in particular, be arranged coaxially to the at least one first capacitor element and the at least one second capacitor element, wherein the at least one first capacitor element and the at least one second capacitor element are positioned radially outside of the shaft and extend around the shaft.

The cavity housing may for example be fabricated out of a metallic first material, for example aluminum. The resonator element, in contrast, may for example be made of a different, second material, for example brass, wherein it also is conceivable to form the resonator element from a non-metallic material, for example a ceramic material.

It also is conceivable to produce the cavity housing and/or the resonator element from a metalized plastic material, for example a plastic having a metal coating.

DRAWINGS

DESCRIPTION

Figure 5:
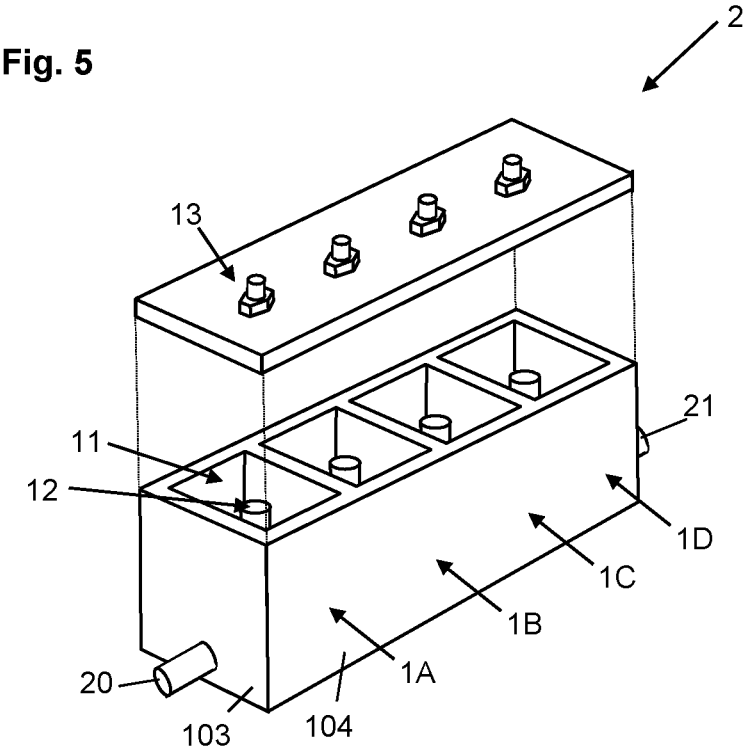
FIG. 5 shows a schematic view of a microwave filter comprising multiple cavity resonators.

A microwave filter 2, as it is schematically shown in FIG. 5, comprises multiple cavity resonators 1A, 1B, 1C, 1D arranged in a common cavity housing 10. Each cavity resonator 1A, 1B, 1C, 1D comprises a cavity 11 in which a resonator element 12 is located. The cavity housing 10 comprises housing walls 103, 104 and a housing lid 101 and fully encloses the cavity 11 of the multiple cavity resonators 1A, 1B, 1C, 1D.

A microwave filter 2, as schematically shown in FIG. 5, may for example be employed in wireless communication devices and may for example implement a bandpass or bandstop filter. Such microwave filters 2 comprising multiple cavity resonators 1A, 1B, 1C, 1D shall in general exhibit a high quality (Q) factor leading to a low insertion loss. Further, such microwave filters 2 shall be mechanically and electrically stable and be operable over a wide range of temperatures.

Within such microwave filter 2, a radio frequency (RF) signal is fed into an input port 20 and passes through the microwave filter 2 to an output port 21. Dependent on the design of the microwave filter 2, RF signals in a predefined frequency band are passed (bandpass filter) or suppressed (bandstop filter).

Within the cavity 11 of the single cavity resonators 1A, 1B, 1C, 1D, which suitably are electromagnetically coupled for example via openings in the inner housing walls in between the cavities 11 of the cavity resonators 1A, 1B, 1C, 1D, resonator elements 12 in the shape of longitudinally extending rods are placed. Such resonator elements 12 with a first end 120 (see for example FIG. 1A) are connected to a first, bottom housing wall 100 of the housing 10 and extend within the associated cavity 11 along a longitudinal axis L towards a second, top housing wall 101 formed by the housing lid opposite the first housing wall 100. The resonator element 12, together with the cavity housing 10 forming the cavity 11, forms a quarter-wavelength resonator and has an electrical length of a quarter wavelength (at a specified resonant frequency).

The second end 121 opposite the first end 120 of the resonator element 12 herein is not connected to the second housing wall 101 and hence is electrically opened.

Figure 1A:
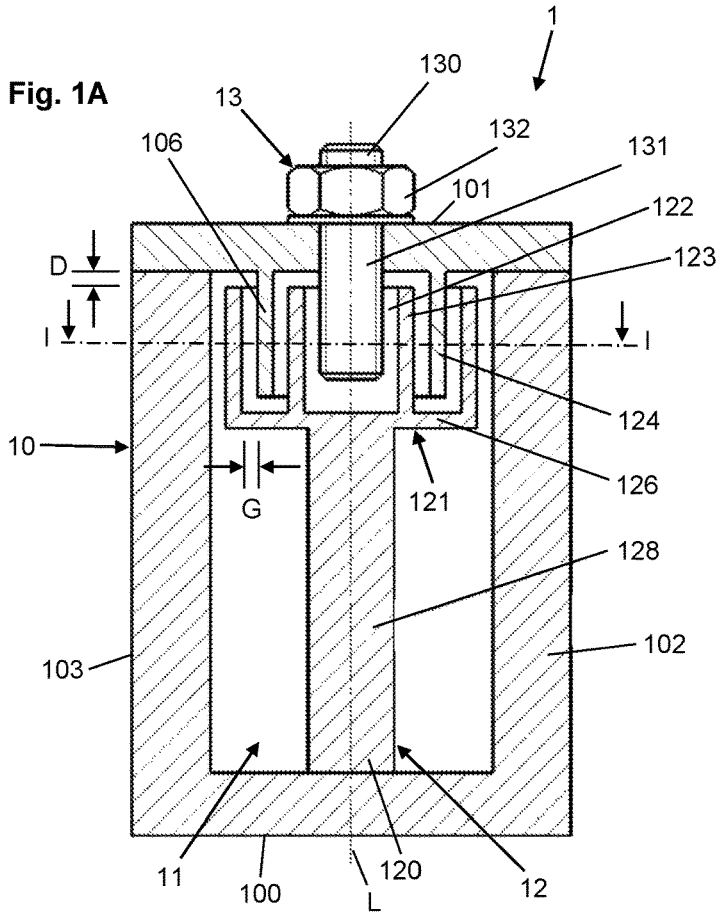
FIG. 1A shows a cross-sectional view of a microwave cavity resonator along line II-II according to FIG. 1B.

In order to shorten the physical length of the resonator element 12 below its electrical length of a quarter wavelength, in the embodiment of FIG. 1A capacitor elements 123, 124 in the shape of cylindrical rings (see FIG. 1B) or quadratic or rectangular elements (see FIG. 1C) are arranged at the second end 121 and intermesh with a capacitor element 106 attached to the second, top housing wall 101 of the cavity housing 10. The capacitor elements 123, 124 of the resonator element 12 as well as the capacitor element 106 of the second housing wall 101 extend circumferentially about the longitudinal axis L and are arranged coaxially with respect to each other and with respect to the longitudinal axis L. The capacitor element 106 attached to the second housing wall 101 herein reaches into an opening formed in between the capacitor elements 123, 124 of the resonator element 12 such that a gap G is formed in-between the capacitor elements 123, 124 of the resonator element 12 and the capacitor element 106 of the second housing wall 101.

The second end 121 of the resonator element 12 with the capacitor elements 123, 124 arranged thereon is spaced apart from the upper, second housing wall 101 of the cavity housing 10 by a distance D such that the second end 121 of the resonator element 12 is not electrically connected to the second housing wall 101. Because the surfaces of the capacitor elements 123, 124, 106 can be large, a comparatively large capacitance in-between the second end 121 of the resonator element 12 and the surrounding housing 10, namely side walls 102, 103, 104, 105 and the top wall 101, can be provided.

Because the capacitance in-between the second end 121 of resonator element 12 and the surrounding housing 10 can be large, the physical length of the resonator element 12 can be substantially shortened, such that a reduction of the overall dimensions of the cavity resonator 1 becomes possible while at the same time allowing for a high Q factor and low insertion loss of a corresponding microwave filter 2.

With the design described herein, the gap G in between the capacitor element 106 of the second, top housing wall 101 and the inner capacitor element 123 on the one hand and the outer capacitor element 124 on the other hand of the resonator element 12 can be chosen such that a mechanically and consequently electrically stable behavior of the resonator 1 over a wide range of operational temperatures is obtained. In particular, because the gap G can be chosen relatively large (for example in the range of 1 mm), the resonator 1 can be insensitive to tolerances and hence can be easily manufactured without paying particular attention to tight tolerances.

The capacitor elements 123, 124 of the resonator element 12 and the capacitor element 106 of the second housing wall 101 extend about the longitudinal axis L in a ring-like coaxial fashion. The capacitor elements 123, 124 herein are carried by a common base 126 and, via the base 126, are attached to a shaft 128 of the resonator element 12. The base 126 is arranged at a side of the capacitor elements 123, 124 opposite the second housing wall 101 and, together with the capacitor elements 123, 124, forms a groove-like opening into with the capacitor element 106 arranged on the second housing wall 101 extends.

The capacitor elements 123, 124 may be integrally formed with the resonator element 12 and may for example be made of brass.

The capacitor element 106 of the second housing wall 101 may be integrally formed with the second housing wall 101 and may be fabricated, as the entire housing 10, for example of aluminum.

The radially innermost capacitor element 123 of the resonator element 12 forms an inner, central opening 122, into which a shaft 131 of a tuning device 13 in the shape of a tuning screw extends. The tuning device 13 is arranged on the second housing wall 101. The shaft 131 reaches through the second housing wall 101 and is rotatable about the longitudinal axis L such that the length of the shaft 131 extending into the cavity 11 of the cavity resonator 1 along the longitudinal axis L can be adjusted. The shaft 131 is screwed into a screw nut 132 placed on the housing wall 101 and, at an end 130 outside the cavity 11, can be accessed by using a tool like a screw driver or the like. The shaft 131 is for example made of a metallic material, such as aluminum or brass.

Figure 1B:
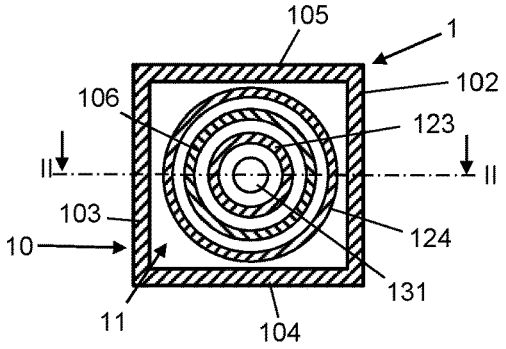
FIG. 1B shows a cross-sectional view of the microwave cavity resonator along line I-I according to FIG. 1A.

As shown in FIG. 1B, the capacitor elements 106, 123, 124 may have a cylindrical shape extending around the longitudinal axis L and being arranged in a coaxial fashion.

Figure 1C:
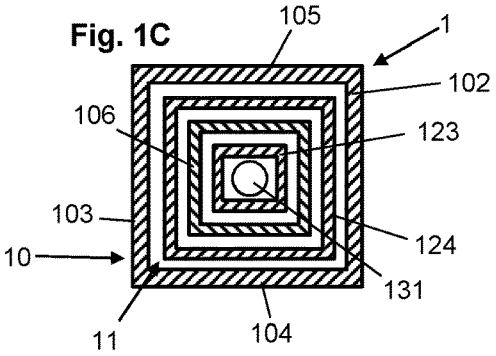
FIG. 1C shows a cross-sectional view of a modified embodiment of a microwave cavity resonator.

The capacitor elements 106, 123, 124, however, may also have a different shape, for example a quadratic or rectangular shape (when viewed in a cross-sectional plane perpendicular to the longitudinal axis L), as it is illustrated in FIG. 1C.

Figure 2:
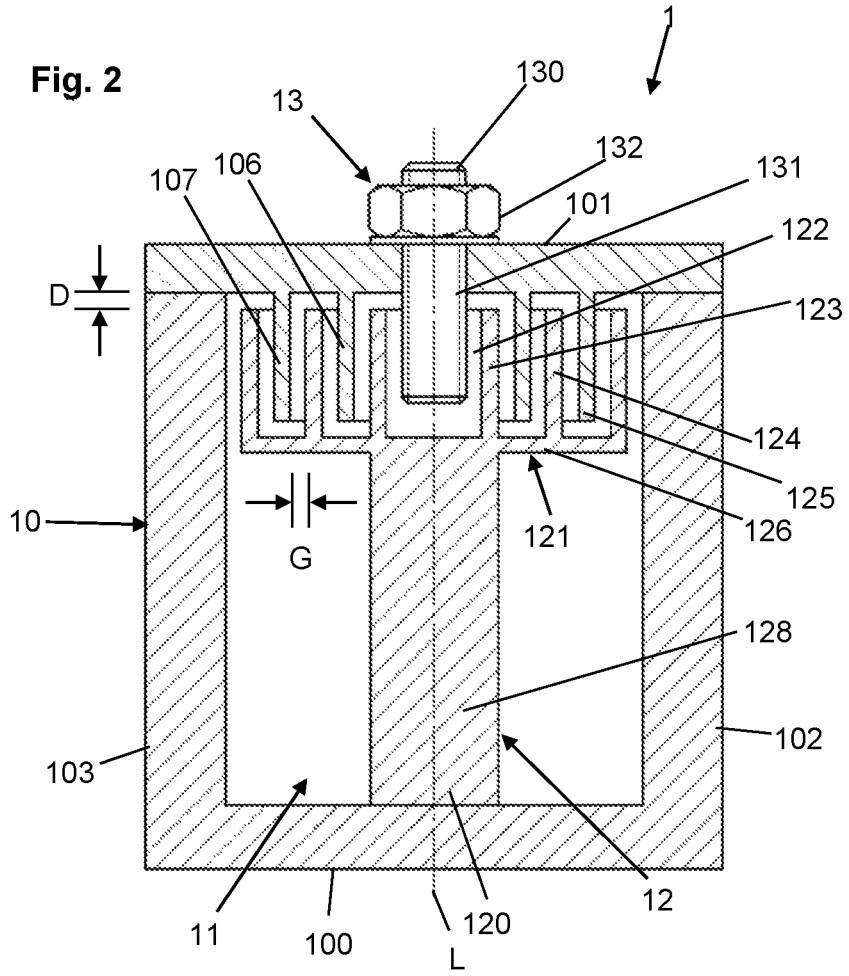
FIG. 2 shows a cross-sectional view of a different embodiment of a microwave cavity resonator.

Another embodiment of a resonator element 1 is shown in FIG. 2. In this embodiment, the resonator element 12 carries a base 126 with three coaxial capacitor elements 123, 124, 125 attached thereto, the capacitor elements 123, 124, 125 being arranged coaxially with respect to each other and extending circumferentially around the longitudinal axis L along which the resonator element 12 extends and. Two capacitor elements 106, 107 are arranged on the second housing wall 101 of the housing 10, the capacitor elements 106, 107 intermeshing with the capacitor elements 123, 124, 125 of the resonator element 12 such that a gap G is formed in-between neighboring capacitor elements 106, 107, 123, 124, 125.

It is conceivable to increase the number of capacitor elements 123, 124, 125 of the resonator element 12 on the one hand and of the capacitor elements 106, 107 of the housing 10 on the other hand even further. Multiple capacitor elements 123, 124, 125 of the resonator element 12 hence may be arranged to intermesh with multiple capacitor elements 106, 107 of the housing 10. The capacitor elements 123, 124, 125, 106, 107 of the resonator element 12 and of the housing 10 herein alternate when viewed in the radial direction (perpendicular to the longitudinal axis L).

Figure 3A:
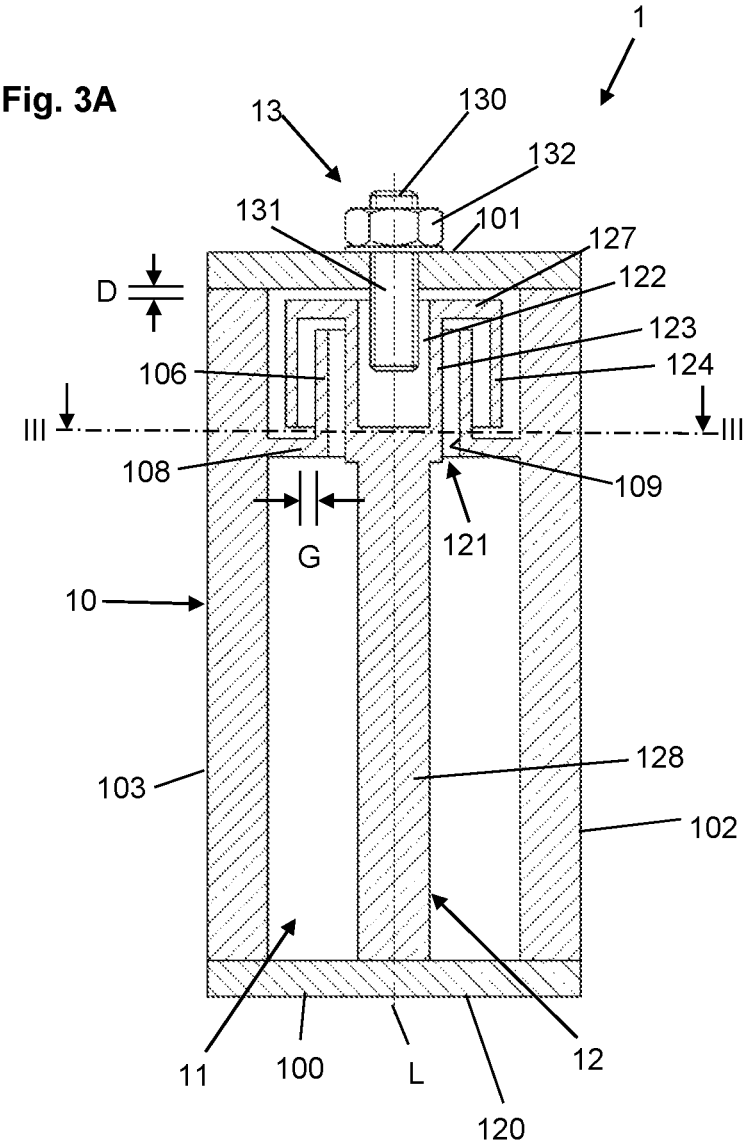
FIG. 3A shows a cross-sectional view of yet another embodiment of a microwave cavity resonator.
Figure 3B:
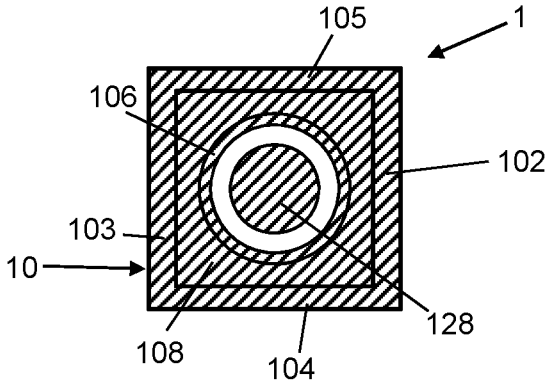
FIG. 3B shows a cross-sectional view along line III-III according to FIG. 3A.

Another embodiment of a resonator element 1 is shown in FIG. 3A, 3B. In this embodiment, two capacitor elements 123, 124 extending circumferentially about the longitudinal axis L of the resonator element 12 are arranged at the second end 121 of the resonator element 12, wherein an outer capacitor element 124 is connected to an inner capacitor element 123 via a base 127 at a side of the capacitor elements 123, 124 facing the second housing wall 101. The capacitor elements 123, 124 extend from the base 127 towards the first, bottom housing wall 100. Via the inner capacitor element 123 the base 127 is connected to the shaft 128 of the resonator element 12.

The capacitor elements 123, 124 of the resonator element 12 form a groove-like opening in-between them into which a capacitor element 106 of the housing 10 extends. The capacitor element 106 is connected via a circumferential base 108 to the side walls 102, 103, 104, 105 of the housing 10 and hence is carried by the side walls 102, 103, 104, 105 of the housing 10 (see FIG. 3B). The base 108 extends in a plane perpendicular to the longitudinal axis L, and from the base 108 the capacitor element 106 extends upwardly towards the second housing wall 101 into the groove-like opening formed in-between the capacitor elements 123, 124 on the second end 121 of the resonator element 12. The base 108 forms an opening 109 through which the resonator element 12 extends with the capacitor element 123 formed on the second end 121 of the resonator element 12.

Figure 4A:
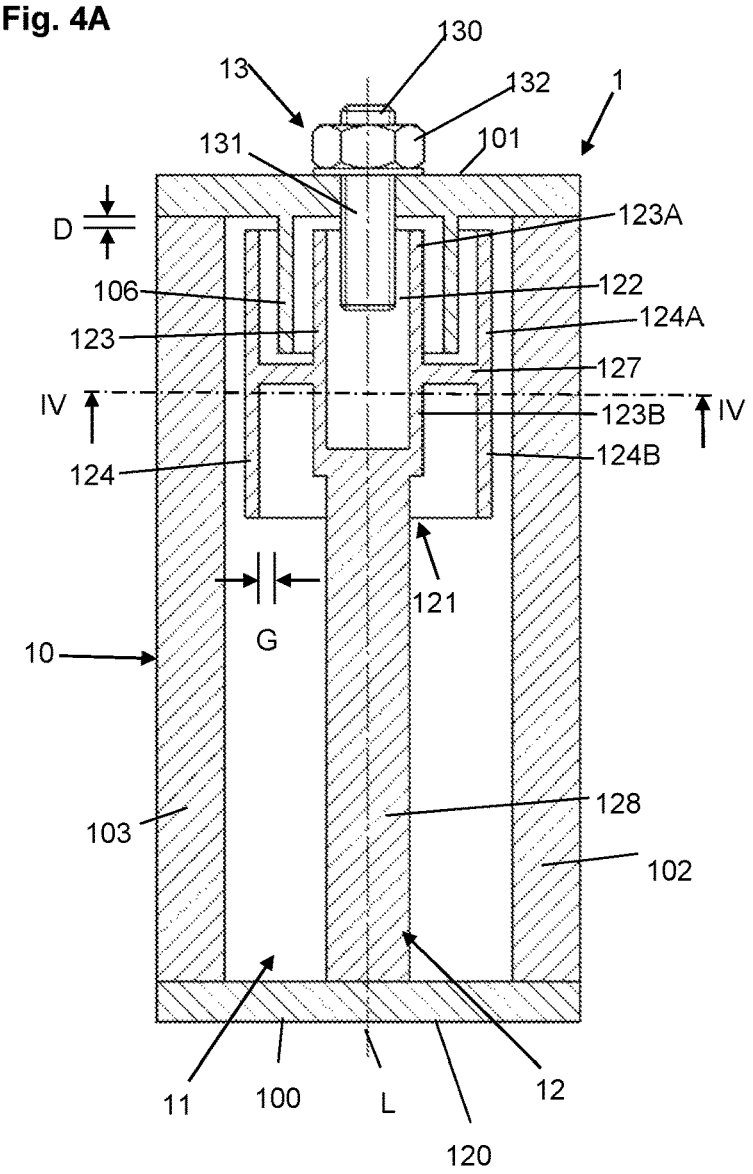
FIG. 4A shows a cross-sectional view of yet another embodiment of a microwave cavity resonator.
Figure 4B:
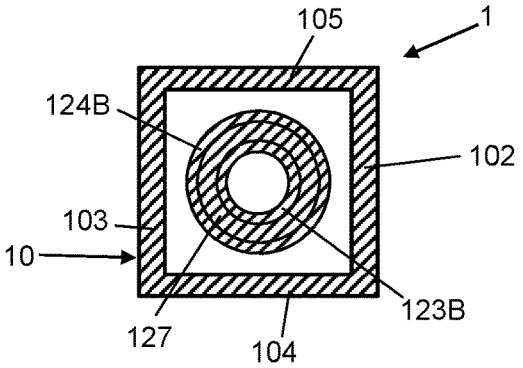
FIG. 4B shows a cross-sectional view along line IV-IV according to FIG. 4A.

Another embodiment of a cavity resonator 1 is shown in FIG. 4A, 4B. In the embodiment of FIG. 4A, 4B two capacitor elements 123, 124 are arranged on the second end 121 of the resonator element 12. The capacitor elements 123, 124 are connected to each other via a base 127 extending in a ring-like fashion in a plane perpendicular to the longitudinal axis L of the resonator element 12, as it is shown in FIG. 4B.

The base 127, in the embodiment of FIG. 4A, 4B, divides the capacitor elements 123, 124 of the resonator element 12 into two portions 123A, 123B, 124A, 124B. Namely, an upper portion 123A, 124A of each capacitor element 123, 124 extends from the base 127 towards the second housing wall 101 and forms a groove-like opening extending circumferentially about the longitudinal axis L into which a capacitor element 106 connected to the second housing wall 101 extends, similarly as it has been described for the embodiment of FIGS. 1A, 1B and 1C. In addition, a lower portion 123B, 124B of each capacitor element 123, 124 extends from the base 127 towards the first housing wall 100 and hence towards the bottom of the cavity 11, wherein via the lower portion 123B of the inner capacitor element 123 the base 127 is connected to the shaft 128 of the resonator element 12.

Via the outer capacitor element 124 of the resonator element 12 an (increased) capacitance in-between the second, open end 121 of the resonator element 12 and the surrounding side walls 102-105 of the housing 10 in the vicinity of the second, open end 121 is provided. Namely, the outer capacitor element 124 faces with its upper and lower portion 124A, 124B the side walls 102, 103, 104, 105 of the housing 10 with a gap G similar or equal to the gap G in-between the capacitor element 106 of the second housing wall 101 and the capacitor elements 123, 124.

Modifications of the embodiments described above are conceivable.

For example, in the embodiment of FIG. 4A, 4B an additional capacitor element of the housing 10 may be connected via a base to the side walls 102, 103, 104, 105 (similar as shown in FIG. 3A, 3B) and may reach into the opening formed in-between the lower portions 123B, 124B of the capacitor elements 123, 124 of the resonator element 12.

It further is conceivable to use different numbers of capacitor elements on the resonator element 12 as well as on the housing 10. Multiple capacitor elements of the resonator element 12 and the housing 10 herein are arranged to intermesh with each other such that, when viewed in the radial direction radially to the longitudinal axis L a gap G is formed in-between neighboring capacitor elements.

The idea underlying the invention is not limited to the embodiments described above, but may be implemented in an entirely different fashion in entirely different embodiments.

LIST OF REFERENCE NUMERALS

1, 1A-1D Microwave cavity resonator
10 Cavity housing
100, 101 Housing wall
102-105 Side wall
106, 107 Capacitor element
108 Base
109 Opening
11 Cavity
12 Resonator element
120, 121 End
122 Central opening
123-125 Capacitor element
123A, 123B, 124A, 124B Portion
126, 127 Base
128 Shaft
13 Tuning device
130 End
131 Shaft
132 Screw nut
2 Microwave filter
20 Input port
21 Output port
D Distance
G Gap
L Longitudinal axis

The invention claimed is:

1. A microwave cavity resonator, comprising:

a cavity housing forming a cavity, the cavity housing comprising a first housing wall and a second housing wall opposite the first housing wall, and a resonator element arranged in the cavity and extending longitudinally along a longitudinal axis, wherein the resonator element comprises, when viewed along the longitudinal axis, a first end connected to the first housing wall and a second end opposite the first end, the second end being arranged at a distance from the second housing wall, wherein the resonator element, at the second end thereof, comprises at least one first capacitor element and the cavity housing comprises at least one second capacitor element reaching into the cavity and arranged at a distance, when viewed along a direction perpendicular to the longitudinal axis, from the at least one first capacitor element such that a gap between the at least one first capacitor element and the at least one second capacitor element is formed;

wherein a shaft of a tuning device is arranged coaxially to the at least one first capacitor element and the at least one second capacitor element and reaches into an opening formed at the second end of the resonator element.

2. The microwave cavity resonator according to claim 1, wherein the at least one first capacitor element and the at least one second capacitor element are arranged coaxially to each other.

3. The microwave cavity resonator according to claim 1, wherein the at least one first capacitor element and the at least one second capacitor element extend about the longitudinal axis.

4. The microwave cavity resonator according to claim 1, wherein the resonator element comprises multiple first capacitor elements.

5. The microwave cavity resonator according to claim 1, wherein the cavity housing comprises multiple second capacitor elements.

6. The microwave cavity resonator according to claim 1, wherein, when viewed along the direction perpendicular to the longitudinal axis, one of the at least one second capacitor element is arranged spatially in between two first capacitor elements.

7. The microwave cavity resonator according to claim 1, wherein one of the at least one first capacitor element is arranged spatially in between two second capacitor elements.

8. The microwave cavity resonator according to claim 1, wherein the at least one second capacitor element is arranged on the second housing wall and extends from the second housing wall into the cavity.

9. The microwave cavity resonator according to claim 1, wherein the at least one second capacitor element is arranged on a side wall of the cavity housing extending in between the first housing wall and the second housing wall.

10. The microwave cavity resonator according to claim 1, wherein the at least one first capacitor element comprises multiple first capacitor elements that are connected to each other via a first base extending along a plane perpendicular to the longitudinal axis.

11. The microwave cavity resonator according to claim 10, wherein the multiple first capacitor elements extend from the first base towards at least one of the second housing wall and the first housing wall.

12. The microwave cavity resonator according to claim 10, wherein a first portion of the at least one first capacitor element extends from the first base towards the second housing wall and a second portion of the at least one first capacitor element extends from the first base towards the first housing wall.

13. The microwave cavity resonator according to claim 1, wherein the at least one second capacitor element comprises multiple second capacitor elements that are connected to each other via a second base extending along a plane perpendicular to the longitudinal axis.

14. The microwave cavity resonator according to claim 1, wherein the tuning device is arranged at the second housing wall, wherein the shaft of the tuning device extends into the cavity along the longitudinal axis, wherein a position of the shaft is adjustable along the longitudinal axis in order to tune the microwave cavity resonator.

15. The microwave cavity resonator according to claim 1, wherein the cavity housing is made of a metallic first material, and the resonator element is made of a different, second material.

16. The microwave cavity resonator according to claim 15, wherein the metallic first material comprises aluminum, and wherein the different, second material comprises brass.

* * * * *